US011932988B2

(12) United States Patent
Swails et al.

(10) Patent No.: US 11,932,988 B2
(45) Date of Patent: Mar. 19, 2024

(54) FOAM-BASED MANUFACTURING SYSTEM AND PROCESS

(71) Applicant: Kimberly-Clark Worldwide, Inc., Neenah, WI (US)

(72) Inventors: Marvin E. E. Swails, Alpharetta, GA (US); Vicky S. Polashock, Roswell, GA (US); Michael Payne, Acworth, GA (US); Joseph K. Baker, Cumming, GA (US); Charles W. Colman, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 17/789,463

(22) PCT Filed: Dec. 30, 2020

(86) PCT No.: PCT/US2020/067419

§ 371 (c)(1),
(2) Date: Jun. 27, 2022

(87) PCT Pub. No.: WO2021/138393

PCT Pub. Date: Jul. 8, 2021

(65) Prior Publication Data

US 2023/0074870 A1 Mar. 9, 2023

Related U.S. Application Data

(60) Provisional application No. 62/955,481, filed on Dec. 31, 2019.

(51) Int. Cl.

| | |
|---|---|
| ***D21C 3/00*** | (2006.01) |
| ***D21F 1/02*** | (2006.01) |
| ***D21F 1/80*** | (2006.01) |

(52) U.S. Cl.
CPC ..... *D21C 3/003* (2013.01); *D21F 1/024* (2013.01); *D21F 1/80* (2013.01)

(58) Field of Classification Search
CPC ..... D21H 17/02; D21H 17/03; D21H 17/11; D21H 21/56; D21H 17/72; D21F 1/024;
(Continued)

(56) References Cited

U.S. PATENT DOCUMENTS 3,506,538 A * 4/1970 Friedberg ..... D21F 11/002 162/344
4,443,297 A * 4/1984 Cheshire ..... D21F 11/002 162/190

(Continued)

FOREIGN PATENT DOCUMENTS

CN 103153147 A * 6/2013 ..... A47K 10/16
EP 4036306 A1 * 8/2022

(Continued)

OTHER PUBLICATIONS

Cheng, Julie, "Papermaking Unit Operations: How They Work, How They Are Affected by Wet-End Chemicals, and How They Affect the Performance of Wet-End Additives", N.C. State University Dept. of Forest Biomaterials, https://projects.ncsu.edu/project/hubbepaperchem/FB527/F01_UnOp.htm.

(Continued)

*Primary Examiner* — Jose A Fortuna
(74) *Attorney, Agent, or Firm* — Dority & Manning, P.A.

(57) ABSTRACT

A system comprising a pulper configured to (i) accept surfactant, a liquid and fiber stock and (ii) generate a foam that suspends the fiber stock, wherein the foam has a half-life; a headbox configured to receive the foam-suspended fiber stock from the pulper and displace the foam-suspended fiber stock onto a forming wire, wherein a time it takes the foam-suspended fiber stock to move from the (Continued)

pulper to the headbox is less than the half-life; and a foam return device that removes at least some of the foam from the forming wire and returns the at least some of the foam to the pulper.

17 Claims, 3 Drawing Sheets

(58) Field of Classification Search
CPC ..... D21F 1/80; D21F 1/66; D21F 9/00; D21C 3/003
See application file for complete search history.

(56) References Cited

U.S. PATENT DOCUMENTS

| | | | | |
|---|---|---|---|---|
| 4,498,956 | A | 2/1985 | Cheshire et al. | |
| 4,543,156 | A | 9/1985 | Cheshire et al. | |
| 4,686,006 | A | 8/1987 | Cheshire et al. | |
| 4,764,253 | A | 8/1988 | Cheshire et al. | |
| 5,200,035 | A | 4/1993 | Bhat et al. | |
| 5,720,851 | A | 2/1998 | Reiner | |
| 6,103,060 | A | 8/2000 | Munerelle et al. | |
| 6,238,518 | B1 * | 5/2001 | Rokman | D21F 9/003 162/190 |
| 6,444,088 | B2 | 9/2002 | Rökman et al. | |
| 6,607,783 | B1 | 8/2003 | Vander Heiden et al. | |
| 6,752,905 | B2 | 6/2004 | Hu et al. | |
| 6,921,459 | B2 * | 7/2005 | Kinsley, Jr. | D21H 27/00 162/101 |
| 7,442,278 | B2 | 10/2008 | Murray et al. | |
| 8,293,072 | B2 | 10/2012 | Super et al. | |
| 8,394,236 | B2 | 3/2013 | Edwards et al. | |
| 9,267,240 | B2 | 2/2016 | Lee et al. | |
| 10,301,775 | B2 * | 5/2019 | Nordström | H01J 37/317 |
| 11,015,292 | B2 | 5/2021 | Venema et al. | |
| 11,313,061 | B2 * | 4/2022 | Nhan | D04H 1/68 |
| 11,591,755 | B2 * | 2/2023 | Qin | D21H 27/004 |
| 11,807,986 | B2 | 11/2023 | Venema et al. | |
| 2002/0066544 | A1 | 6/2002 | Dwiggins et al. | |
| 2003/0192661 | A1 | 10/2003 | Elonen et al. | |
| 2005/0039870 | A1 | 2/2005 | Blomqvist et al. | |
| 2015/0330029 | A1 * | 11/2015 | Ramaratnam | A47L 13/17 162/111 |
| 2019/0226133 | A1 | 7/2019 | Venema et al. | |
| 2020/0190739 | A1 * | 6/2020 | Qin | D21H 15/10 |
| 2023/0074870 | A1 * | 3/2023 | Swails | D21H 21/56 |
| 2023/0131582 | A1 * | 4/2023 | Qin | D04H 1/407 428/213 |
| 2023/0135217 | A1 * | 5/2023 | Heiskanen | B32B 29/005 162/127 |
| 2023/0149226 | A1 * | 5/2023 | Qin | A61F 13/53 604/378 |

FOREIGN PATENT DOCUMENTS

| | | | | |
|---|---|---|---|---|
| EP | 4036307 | A1 * | 8/2022 | |
| ES | 2612453 | T3 * | 5/2017 | A61K 8/0208 |
| GB | 1329409 | A * | 9/1973 | D21F 11/002 |
| JP | 2002519538 | A * | 7/2002 | D21F 11/00 |
| WO | WO-0001882 | A1 * | 1/2000 | D21F 11/002 |
| WO | 2016193547 | A1 | 12/2016 | |
| WO | WO-2021138393 | A1 * | 7/2021 | D21C 3/003 |

OTHER PUBLICATIONS

European Search Report Corresponding to Application No. 20910398.5 dated Dec. 19, 2023.

* cited by examiner

FOAM-BASED MANUFACTURING SYSTEM AND PROCESS

This application claims priority to and benefit of U.S. Patent Application Ser. No. 62/955,481, filed on Dec. 31, 2019, entitled Foam-Based Manufacturing System and Process, the entire contents of which are herein incorporated by reference.

BACKGROUND

In the nonwovens field utilizing surfactants to generate foam for the purpose of suspending and dispersing fiber stock is known. However, is it difficult to manage and handle foam throughout the paper making system and process, as the foam can, for example, migrate to areas of the system where it is not wanted or needed and create process degradations and down-time (e.g., to remove the foam from these areas).

SUMMARY

In general, the present disclosure relates to a process and system to manage foam use in making nonwoven materials. In general, one aspect of the subject matter described in this specification can be implemented a system comprising a pulper configured to (i) accept surfactant, a liquid and fiber stock and (ii) generate a foam that suspends the fiber stock, wherein the foam has a half-life; a headbox configured to receive the foam-suspended fiber stock from the pulper and displace the foam-suspended fiber stock onto a forming wire, wherein a time it takes the foam-suspended fiber stock to move from the pulper to the headbox is less than the half-life; and a foam return device that removes at least some of the foam from the forming wire and returns the at least some of the foam to the pulper. Other embodiments of this aspect include corresponding methods.

Yet another aspect of the subject matter described in this specification can be implemented in a method comprising generating a foam in a pulper; adding fiber stock to the pulper; transporting the foam and fiber stock to a headbox in a time less than or equal to a half-life of the foam; displacing the foam and fiber stock on a forming wire; and returning at least a portion of the foam from the forming wire to the pulper. Other embodiments of this aspect include corresponding systems.

Another aspect of the subject matter described in this specification can be implemented in a system comprising a pulper configured to (i) accept surfactant, a liquid and fiber stock and (ii) generate a foam that suspends the fiber stock, wherein the foam-suspended fiber stock in the pulper has a first volume; a headbox configured to receive the foam-suspended fiber stock from the pulper and displace the foam-suspended fiber stock onto a forming wire, the foam-suspended fiber stock in the headbox has a second volume and wherein the second volume is equal to or greater than half of the first volume; and a foam return device that removes at least some of the foam from the forming wire and returns the at least some of the foam to the pulper. Other embodiments of this aspect include corresponding methods.

A further aspect of the subject matter described in this specification can be implemented in a system comprising a pulper configured to mix foam and fiber stock; and a headbox configured to (i) receive the mixed foam and fiber stock from the pulper without additional surfactant being added (a) between the pulper and headbox or (b) at the headbox and (ii) displace the mixed foam and fiber stock onto a forming wire. Other embodiments of this aspect include corresponding methods.

Particular embodiments of the subject matter described in this specification can be implemented so as to realize one or more of the following advantages. For example, the system described herein is provided to control foam from spreading to unwanted parts of the system and process thereby avoiding time-consuming and expensive clean-ups to remove foam from those unwanted parts. Additionally, this system reduces (and in some cases) eliminates the need to separate and recover surfactant from liquid streams downstream from the headbox. Further, this system reduces or minimizes the need to add additional surfactant or foam as the system moves the fiber stock-containing foam from the pulper to the headbox without the need to add more foam along that path. Moreover the system reduces the amount of foam (and/or surfactant) required to be added to the pulper as the system recovers foam from the headbox and forming wire and returns the foam to the pulper by creating a closed-loop type system for managing the foam from the pulper to the headbox and back to the pulper.

The details of one or more implementations of the subject matter described in this specification are set forth in the accompanying drawings and the description below. Other features, aspects, and advantages of the subject matter will become apparent from the description, the drawings, and the claims.

Figure 1A:
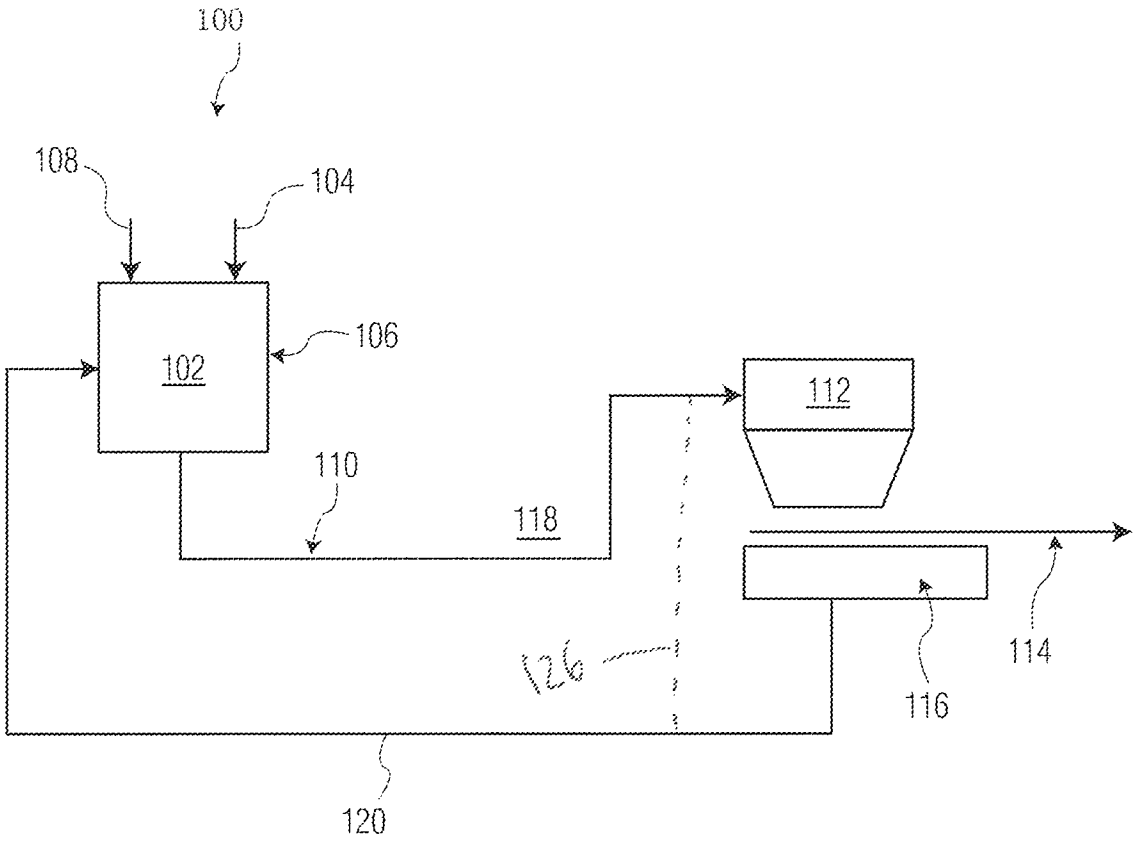
FIG. 1A is a block diagram of an example nonwovens system to create a foam formed product.

Repeat use of reference characters in the present specification and drawings is intended to represent the same or analogous features or elements of the present invention.

DETAILED DESCRIPTION

The present disclosure generally relates to using foam in a manufacturing process to create nonwoven materials. For example, a system for such a manufacturing process includes a pulper that accepts fibers, a liquid (e.g., water), and a surfactant. The pulper mixes (e.g., agitates) the surfactant and liquid together to create a foam. The pulper also mixes the foam with the fibers to create a foam suspension of fibers in which the foam holds and separates the fibers to facilitate a uniform or near uniform distribution of the fibers within the foam (e.g., as an artifact of the mixing process in the pulper). Uniform fiber distribution promotes desirable nonwoven material characteristics including, for example, strength and the visual appearance of quality.

The foam suspension of fibers is then transported to a headbox, which lays the fibers down on a forming wire to create a matrix of fibers. Given that foam loses its volume over time (e.g., it defoams as the bubbles forming the foam collapse) the fibers in the foam tend to become less evenly distributed or less uniform as the fibers clump together without the bubbles to separate them.

As such, to reduce the likelihood of the fiber suspension, for example, losing its uniformity, the system transports the fiber suspension from the pulper to headbox (and optionally back) in a time that is less than the half-life of the foam, which provides that at least half of the foam, and corresponding bubble content, created at the pulper makes it to the headbox. With at least half of the original amount of foam the fiber suspension is likely to maintain good uniformity/uniform distribution of fibers.

Further, the system may also recover at least some of the foam deposited on the wire and return that recovered foam directly to the pulper (e.g., within the half-life of the foam). For example, the system collects foam deposited on the wire and transports the foam to the pulper without any intervening equipment designed to collapse the foam or separate the foam into its constituent parts and/or otherwise return (e.g., any material quantity of) the foam or its constituent parts directly back to the headbox. This system and process are discussed in more detail below with reference to FIGS. 1A and 1B.

Figure 1B:
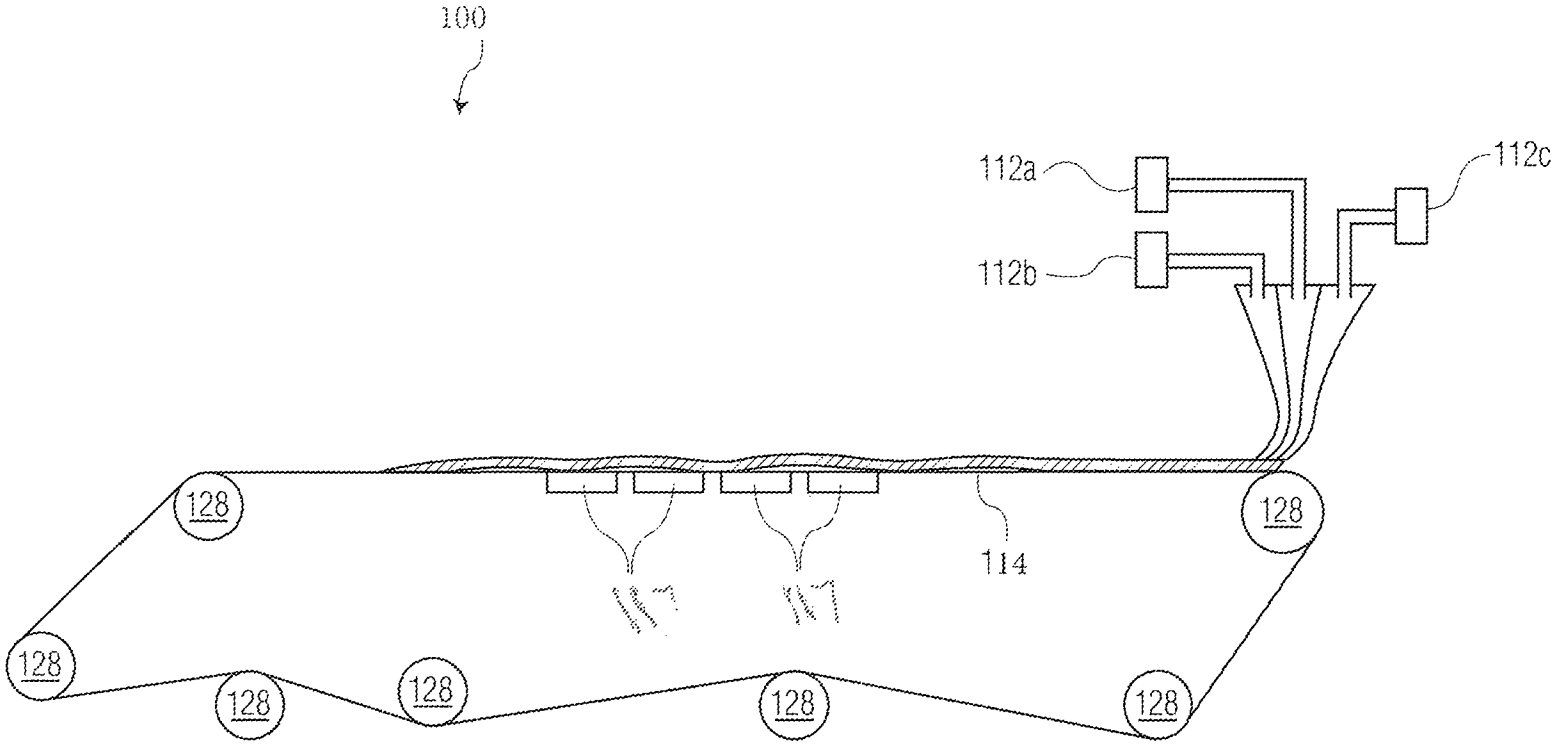
FIG. 1B a second block diagram of an example nonwovens system to create a foam formed product.

FIG. 1A is a block diagram of an example nonwovens system 100 to create a foam formed product, and FIG. 1B is a second block diagram of an example nonwovens system 100 to create a foam formed product.

A foam formed product is a product formed from a suspension including a mixture of a solid, a liquid, and dispersed gas bubbles. Solids in the suspension for a foam formed product can include solid particulates, such as, for example, natural and/or man-made fibers. Other solids that can be added in the suspension, for example, include superabsorbent material like activated carbon, micro-encapsulated active ingredients, calcium carbonate, titanium dioxide. Liquids in the suspension for the foam formed product can, for example, include water. In some implementations, surfactants can, for example, be utilized in the suspension. The suspension for the foam formed product can, for example, include air as a gas component that forms dispersed gas bubbles. In some implementations, the air content within the suspension can range from about 20% to about 95% or from about 30% to about 80%. In some implementations, the gas bubbles can include an alternative or an additional gas.

In some implementations, for example, a foam is first formed by combining a liquid (e.g., water) with a foaming agent. The foaming agent, for example, may include or be a surfactant. For example, the surfactant(s) included in the suspension for the foam formed product may be selected from anionic, cationic, nonionic, zwitterionic, and amphoteric surfactants.

Without limitation, example amphoteric surfactants include coco-betaine, cocamidopropyl betaine, and capryl/capramidopropyl betaine, cocamidopropyl hydroxysultaine, cocamie oxide and lauramine oxide, an example anionic surfactant includes sodium lauryl sulfate, potassium laureth phosphate, sodium isethionate, an example cationic cetrimonium chloride and example nonionic surfactants include laureth 23, laureth 30, PEG-7 glyceryl cocoate, caprylyl/capryl glucoside, lauryl glucoside, decyl glucoside and coco-glucoside.

In some implementations, the surfactant is combined with liquid generally in an amount greater than about 0.2%, 0.5%, or 1%, by weight, such as in an amount greater than about 5% by weight, such as in an amount greater than about 10% by weight, such as in an amount greater than about 15% by weight. One or more surfactants are generally present in an amount less than about 50% by weight, such as in an amount less than about 40% by weight, such as in an amount less than about 30% by weight, such as in an amount less than about 20% by weight.

Referring to FIG. 1A, the pulper 102 accepts the surfactant(s) 104, the liquid (e.g., water) 106 and fiber stock 108 and generate(s) a foam in the pulper 102 that suspends the fiber stock 108. In some implementations, the pulper 102 includes one or more agitation blades that mix or blend the surfactant 104 and liquid 106 to form the foam and (either subsequently or currently) mix or blend the fiber stock 108 with the foam to form a foam-suspended fiber stock 110, which is the blend or mixture of the fiber stock 108 in the foam created by the liquid 106 and the surfactant 104. More generally, a foam refers to a porous matrix, which is an aggregate of hollow cells or bubbles which may be interconnected to form channels or capillaries. For example, the individual fibers of the fiber stock 108 are (e.g., uniformly) distributed throughout the foam in these channels or capillaries as a result of the mixing process of the pulper 102.

Fibers in the fiber stock 108 may include various natural or synthetic cellulosic fibers including, but not limited to nonwoody fibers, such as cotton, abaca, kenaf, sabai grass, flax, esparto grass, straw, jute hemp, bagasse, milkweed floss fibers, and pineapple leaf fibers; and woody or pulp fibers such as those obtained from deciduous and coniferous trees, including softwood fibers, such as northern and southern softwood kraft fibers; hardwood fibers, such as eucalyptus, maple, birch, and aspen. Pulp fibers can be prepared in high-yield or low-yield forms and can be pulped in any known method, including kraft, sulfite, high-yield pulping methods and other known pulping methods. Fibers prepared from organosolv pulping methods can also be used.

The foam density of the foam can vary depending upon the particular application and various factors including the fiber stock 108 used. In some implementations, for example, the foam density of the foam can be greater than about 100 g/L, such as greater than about 250 g/L, such as greater than about 300 g/L. The foam density is generally less than about 800 g/L, such as less than about 500 g/L, such as less than about 400 g/L, such as less than about 350 g/L. In some implementations, for example, a lower density foam is used having a foam density of generally less than about 350 g/L, such as less than about 340 g/L, such as less than about 330 g/L. The foam will generally have an air content of greater than about 20%, such as greater than about 50%, such as greater than about 60%. The air content is generally less than about 95% by volume, such as less than about 70% by volume, such as less than about 65% by volume.

In some implementations a portion of the fibers in the fiber stock 108, e.g., greater than ten percent and up to one hundred percent, can be synthetic fibers such as rayon, polyolefin fibers, polyester fibers, bicomponent sheath-core fibers, multi-component binder fibers, and the like. An exemplary polyethylene fiber is Fybrel®, available from Minifibers, Inc. (Jackson City, Tenn.). Any known bleaching method can be used. Synthetic cellulose fiber types include rayon in all its varieties and other fibers derived from viscose or chemically-modified cellulose. Chemically treated natural cellulosic fibers can be used such as mercerized pulps, chemically stiffened, debonded or crosslinked fibers, or sulfonated fibers. For good mechanical properties in using papermaking fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable papermaking fibers can also include recycled fibers, virgin fibers, or mixes thereof.

Other papermaking fibers that can be used in the fiber stock 108 include paper broke or recycled fibers and high yield fibers. High yield pulp fibers are those papermaking fibers produced by pulping processes providing a yield of about 65% or greater, more specifically about 75% or greater, and still more specifically about 75% to about 95%. Yield is the resulting amount of processed fibers expressed as a percentage of the initial wood mass. Such pulping processes include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which leave the resulting fibers with high levels of lignin. High yield fibers are well known for their stiffness in both dry and wet states relative to typical chemically pulped fibers.

From the pulper 102 the foam-suspended fiber stock 110 is delivered to the headbox 112 through a conduit 118, for example, a plastic composite or metal pipe or tube. In some implementations there can be equipment or other processing aids between the pulper 102 and headbox 112 while in other implementations there is no such additional equipment including equipment to dilute the foam suspended fiber stock. The headbox 112 then displaces the foam-suspended fiber stock 110 onto a forming wire 114, as described in more detail with reference to FIG. 1B.

The time it takes the system 100 to move the foam-suspended fiber stock 110 (once the foam-suspended fiber stock 110 is sufficiently mixed, for example, as determined by a predetermined schedule) from the pulper 102 to the headbox 112 is less than the half-life of the foam. The half-life of the foam is the time it takes for half of the mass (or liquid volume) of the liquid 106 and surfactant 104 (or other specified constituent components) forming the foam to defoam once the foam has been formed. For example, if, combined, one hundred grams of liquid 106 and surfactant 104 where used to form the foam then once the foam has been formed the half-life of the foam is the time it takes for fifty grams of the foam to defoam into a liquid form.

As described above, the foam keeps the fiber stock 108 uniformly (or quasi-uniformly) distributed such that the majority (or more than 60, 70, 80, 90 or 95%) of the fibers are separated and not clumping or are tangled together. But once the foam has defoamed to less than half of its original mass or liquid volume (e.g., as compared to that in the pulper 102 where it was fully foamed or substantially foamed, for example at least ninety percent foamed) there is not enough foam (e.g., bubble content) remaining to maintain the desired fiber distribution uniformity.

In some implementations, the pulper 102 generates the foam-suspended fiber stock 110 having a first volume and the system 100 delivers the foam-suspended fiber stock 110 to the headbox 112 such that the foam-suspended fiber stock 110 has a second volume in the headbox 112 that is equal to or greater than half of the first volume. This volumetric comparison helps to ensure that there is enough foam remaining at the headbox 112 to provide the desired fiber distribution uniformity. In some implementations, the first and second volumes are measured in terms of the entire foam-suspended fiber stock 110 (i.e., the foam and fiber stock 108) while in other implementations first and second volumes are measured in terms of just the foam.

As such, the system 100 can be designed, for example, to have a conduit 118 to ensure the travel time for the foam-suspended fiber stock 110 between the pulper 102 and the headbox 112 is less than the half-life of the foam, to ensure the speed at which the foam-suspended fiber stock 110 travels through the conduit 118 (and/or other system 100 components) between the pulper 102 and the headbox 112 is fast enough such that, accounting for the length of the conduit 118, the foam-suspended fiber stock 110 reaches the headbox 112 in less time than the half-life of the foam, to use a foam that has a half-life greater than the travel time from the pulper 102 to the headbox 112, or some combination thereof. In some implementations, the conduit 118 directly connects the pulper to the headbox, where directly means that there are no intervening devices or equipment between the pulper 102 and headbox 112 to adjust the fiber consistency by more than, for example, 25%, 50%, 100% or 250%.

The half-lives of various foams were measured according to the following test method.

1. Pour 100 mL of the surfactant 104 and liquid 106 solution into Hamilton Beach B70 Blender, Model 58161, Series A4461CE.
2. Blend the solution on high for 10 seconds with the top flap of the blender open to allow air in to create the foam.
3. Immediately pour foam into a 250 mL graduated cylinder and START the stopwatch.
4. Record the time when the foam defoams to its half-life by recording the time when the liquid line at the bottom of the graduated cylinder reaches 50 mL.

Example cationic and nonionic surfactant-based foams were tested according to this method, as shown in Table 1 below:

TABLE 1

| Charge | Trade Name | INCI Name | Final Activity | Half-Life (minutes: seconds) |
|---|---|---|---|---|
| Nonionic | PLANTAREN 818 | Coco-Glucoside | .156 | 3:23 |
| Cationic | VARISOFT 300 | Cetrimonium Chloride | .241 | 3:51 |

More generally, the half-lives for some foams can vary from about thirty seconds to five minutes.

Given the system 100 is designed to ensure the foam-suspended fiber stock 110 reaches the headbox 112 within the time of the half-life of the foam to promote good fiber distribution uniformity, in some implementations, no additional surfactant 104 (or foam) is required to be added between the pulper 102 and the headbox 112. By no additional surfactant it is meant that no material amount of surfactant 104 is added. A material amount of surfactant 104 is up to ten percent of the original amount of surfactant added to create the foam or preferably up to five percent and more preferably up to two percent and most preferably no additional surfactant is added.

Likewise, in some implementations, no additional liquid 106 is required to be added between the pulper 102 and the headbox 112. By no additional liquid 106 it is meant that no material amount of liquid 106 is added. A material amount of liquid 106 is up to ten percent of the original amount of liquid 106 added to create the foam or preferably up to five percent and more preferably up to two percent and most preferably no additional liquid 106 is added.

As described above the foam-suspended fiber stock 110 is fed into the headbox 112 from the pulper 102. In some implementations, the headbox 112 is a single chambered headbox (meaning it is designed to lay down one layer of fibers at a time) and in other implementations it can be a multi-layered headbox 112 (meaning it is designed to lay down more than one layer of fibers). The headbox 112 shown in FIG. 1B, for example, is a three-chambered headbox 112.

For the headbox of FIG. 1B, foam-suspended fiber stock 110 for a first layer can be fed into a first chamber 112*a*, foam-suspended fiber stock 110 for a second layer can be fed to a second chamber 112*b*, and foam-suspended fiber stock 110 for a third layer can be fed a third chamber 112*c*, which allows a three-layer foam formed product to be made (although this concept can be likewise extended to other multi-layered foam-formed products). The fiber make-up or blend of the foam-suspended fiber stock 110 for each layer can be the same or different from each other. Continuing, in some implementations, from the headbox 112, the foam-suspended fiber stock 110 layer(s) is/are issued onto an endless traveling forming wire 114 supported and driven by rolls 128 in order to form a (e.g., one-ply) three-layered foam formed product.

In some implementations, the foam to fiber stock consistency (e.g., the ratio of the weight of fiber stock 108 to foam) is about 0.5 to 3%, 0.8 to 3% or about 0.75 to 3% or about 1 to 3%, or about 1 to 2% in the pulper 102 and in the headbox 112. In some implementations, the foam to fiber stock consistency between the pulper 102 and the headbox 112 does not change by more than 10%, 25%, 50% or 100%.

Once (or as) the foam-suspended fiber stock 110 is displaced on the forming wire 114, a foam return device 116 can remove foam (and/or surfactant 104 and liquid 106) from the foam-suspended fiber stock 110. In some implementations, this foam return device 116 is a device that includes one or more vacuum boxes that apply suction or a vacuum to the underside of the forming wire 114 to pull out the foam and/or its constituent parts from the displaced foam-suspended fiber stock 110.

In some implementations, as the displaced foam-suspended fiber stock 110, is conveyed downstream excess liquid removal devices 117 can be used (e.g., vacuum boxes). From the forming wire 114, the displaced foam-suspended fiber stock 110 may, for example, be conveyed downstream and dried on a through-air dryer.

As described above, the foam return device 116 can facilitate returning foam to the pulper 102. More specifically, in some implementations, the foam return device 116 removes at least some of the foam from the forming wire 114 (and/or foam-suspended fiber stock 110 as it is laid down on the wire 114) and returns the foam to the pulper 102 for further use. In some implementations, returning at least some of the foam to the pulper 104 includes returning at least some of the surfactant 104 (e.g., as some of the foam has been defoamed into surfactant 104 and liquid 106), some of the surfactant 104 and liquid 106 (e.g., as some of the foam has been defoamed into surfactant 104 and liquid 106), some of the foam (e.g., which has not been defoamed), or some combination thereof. Once, for example, some (or all) of the surfactant 104 or foam has been removed from the displaced foam-suspended fiber stock 110 a conduit 120 (part of the foam return device 116), returns at least some of the surfactant 104 and liquid 106 or foam back to the pulper 102.

In some implementations, returning at least some of the foam (or surfactant 104 and/or liquid 106 if some defoaming has occurred) to the pulper 102 from the forming wire 114 means returning at least 70%, or 80% or 90% of the mass or liquid volume of the foam (e.g., in the headbox) to the pulper 102, and optionally returning the foam (or surfactant 104 and/or liquid 106 if some defoaming has occurred) to the pulper 102 within the half-life of the foam. The liquid volume or mass, respectively, of the foam is the targeted liquid volume or mass of the foam in the headbox during normal (steady-state) operation of the system 100. Thus the goal is to return as much foam to the pulper 102 as possible to reduce the need to add more foam (or surfactant 104 or liquid 106) to the pulper 102. This creates a closed loop for the foam to travel back and forth between the pulper 102 and the headbox 112/forming wire 114.

In some implementations the conduit 120 directly connects the foam return device 116 and the pulper 102. Directly connects here means that there are no intervening devices or equipment between the foam return device 116 and the pulper 102 designed to defoam the foam or store the foam, surfactant and/or liquid for the purpose of separating the surfactant 104 and liquid 106.

In some conventional systems, there is return line from the vacuum boxes (e.g., 116-type devices) under the wire (e.g., 114) to the headbox to pass liquid (e.g., 106) collected from the forming wire to the headbox (e.g. 112) to manage the fiber consistency at the headbox. In some implementations, the system 100 does not have such a return line (e.g., 126) or (if it does) does not return more than 10%, 20%, 30%, 40% or 50% of the foam, surfactant 104 and/or liquid 106 back to the headbox 112 (e.g., without going through the pulper 102).

As such, the system's 100 structure and configuration are designed to prevent the spread of foam (including surfactant 104) to other parts of the system 100 by, for example, reducing the amount of surfactant needed in the system, e.g., by ensuring the foam-suspended fiber stock 110 reaches the headbox 112 within the foam's half-life so no additional surfactant/foam has to be added to keep good foam volume/content and hence good uniform fiber distribution, to help enable the above-described process benefits.

The basis weight of absorbent articles 100 made in accordance with the present disclosure can vary depending upon the final product. For example, the process may be used to produce paper towels, tissue products, industrial wipers, and the like.

Figure 2:
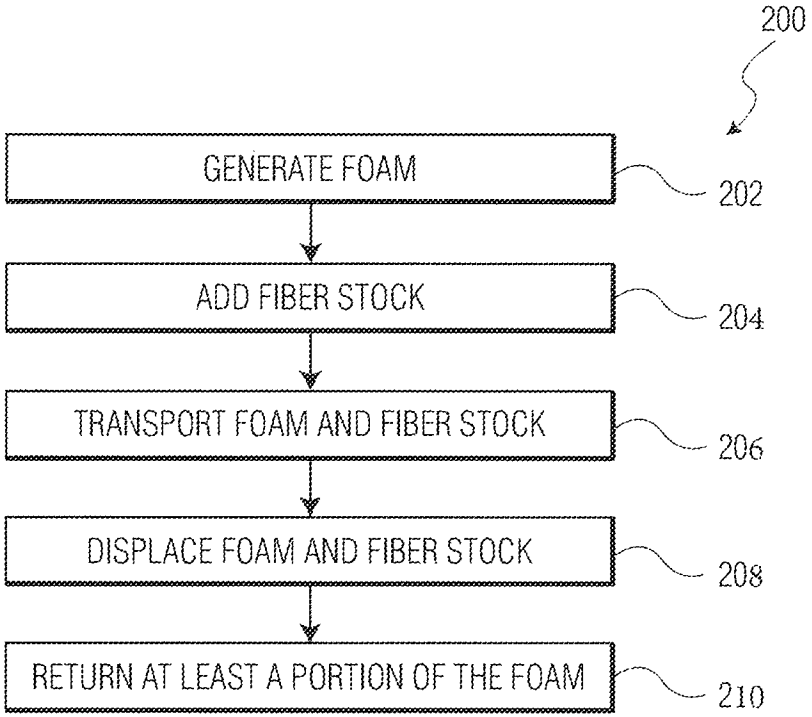
FIG. 2 is a flow diagram of an example process of using foam in a nonwovens system.

FIG. 2 is a flow diagram of an example process 200 of using foam in a nonwovens system 100.

Foam is generated in a pulper (202). For example, the pulper 102 generates foam from surfactant 104 and liquid 106.

Fiber stock is added to the pulper (204). For example, fiber stock 108 is added to the pulper 102, and mixed with the foam, either concurrently with the surfactant 104 and liquid 106 or subsequent to the surfactant 104 and liquid 106.

The foam and fiber stock are transported to a headbox in a time less than or equal to a half-life of the foam (206). For example, the foam and fiber stock 108 are transported to a headbox 112 in a time less than or equal to a half-life of the foam.

The foam and fiber stock are displaced on a forming wire (208). For example, the headbox 112 displaces the foam and fiber stock 108 (e.g., the foam-suspended fiber stock 110) on a forming wire 114.

At least a portion of the foam is returned from the forming wire to the pulper (210). For example, the foam return device 116 (and conduit 120) returns a portion of the foam (or surfactant 104) to the pulper 102, e.g., within the half-life of the foam.

Implementations

Implementation 1. A system comprising a pulper configured to (i) accept surfactant, a liquid and fiber stock and (ii) generate a foam that suspends the fiber stock, wherein the foam has a half-life; a headbox configured to receive the foam-suspended fiber stock from the pulper and displace the foam-suspended fiber stock onto a forming wire, wherein a time it takes the foam-suspended fiber stock to move from the pulper to the headbox is less than the half-life; and a foam return device that removes at least some of the foam from the forming wire and returns the at least some of the foam to the pulper, wherein a time it takes to move the at least some of the foam from the foam return device to the pulper is less than the half-life.

Implementation 2. The system of implementation 1, wherein the at least some of the foam returned to the pulper remains in a foam state from the forming wire to the pulper Implementation 3. The system of any preceding implementation, wherein the surfactant is one of Coco-Glucoside and Cetrimonium Chloride.

Implementation 4. The system of any preceding implementation, wherein the half-life is from thirty seconds to five minutes.

Implementation 5. The system of any preceding implementation, comprising an excess liquid removal device.

Implementation 6. The system of any preceding implementation, wherein the foam-suspended fiber stock in the headbox has a consistency of about 0.5 to 3%.

Implementation 7. The system of any preceding implementation 1-5, wherein the foam-suspended fiber stock in the headbox has a consistency of about 0.75 to 3%.

Implementation 8. The of any preceding implementation 1-5, wherein the foam-suspended fiber stock in the headbox has a consistency of about 1 to 3%.

Implementation 9. The system of any preceding implementation comprising a conduit directly connecting the pulper to the headbox.

Implementation 10. The system any preceding implementation, wherein the foam return device is directly connected to the pulper.

Implementation 11. The system of implementation 10, wherein the foam return device includes a conduit.

Implementation 12. A method comprising generating a foam in a pulper; adding fiber stock to the pulper; transporting the foam and fiber stock to a headbox in a time less than or equal to a half-life of the foam; displacing the foam and fiber stock on a forming wire; and returning at least a portion of the foam from the forming wire to the pulper.

Implementation 13. The method of implementation 12, wherein the generating and adding occur concurrently.

Implementation 14. The method of implementations 12 or 13, wherein transporting the foam and fiber stock to a headbox in a time less than or equal to a half-life of the foam comprises transporting the foam and fiber stock to a headbox in a time less than or equal to a half-life of the foam without adding water during the transporting.

Implementation 15. The method of any of implementation 12-14, wherein the foam and fiber stock in the headbox have a fiber consistency of about 0.5 to 3%.

Implementation 16. The method of any of implementation 12-14, wherein the foam and fiber stock in the headbox have a fiber consistency of about 0.75 to 3%.

Implementation 17. The method of any of implementations 12-14, wherein the foam and fiber stock in the headbox have a fiber consistency of about 1 to 3%.

Implementation 18. A system comprising a pulper configured to mix foam and fiber stock; and a headbox configured to (i) receive the mixed foam and fiber stock from the pulper without additional surfactant being added (a) between the pulper and headbox or (b) at the headbox and (ii) displace the mixed foam and fiber stock onto a forming wire.

Implementation 19. The system of implementation 18 comprising a foam return device that removes at least some of the foam from the forming wire and returns the at least some of the foam to the pulper.

Implementation 20. A system comprising a pulper configured to (i) accept surfactant, a liquid and fiber stock and (ii) generate a foam that suspends the fiber stock, wherein the foam-suspended fiber stock in the pulper has a first volume; a headbox configured to receive the foam-suspended fiber stock from the pulper and displace the foam-suspended fiber stock onto a forming wire, the foam-suspended fiber stock in the headbox has a second volume and wherein the second volume is equal to or greater than half of the first volume; and a foam return device that removes at least some of the foam from the forming wire and returns the at least some of the foam to the pulper.

Implementation 21. The system of implementation 20, wherein the at least some of the foam returned to the pulper remains in a foam state from the forming wire to the pulper.

Implementation 22. The system of implementation 20 or 21, wherein the surfactant is one of Coco-Glucoside and Cetrimonium Chloride.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments.

This written description does not limit the invention to the precise terms set forth. Thus, while the invention has been described in detail with reference to the examples set forth above, those of ordinary skill in the art may affect alterations, modifications and variations to the examples without departing from the scope of the invention.

What is claimed is:

1. A system comprising:

a pulper configured to (i) accept surfactant, a liquid and fiber stock, and (ii) generate a foam that suspends the fiber stock, and (iii) mix the surfactant, liquid and fiber stock; and wherein the foam has a half-life;

a headbox configured to receive the foam-suspended fiber stock from the pulper and displace the foam-suspended fiber stock onto a forming wire, wherein a time it takes the foam-suspended fiber stock to move from the pulper to the headbox is less than the half-life;

a conduit directly connecting the pulper to the headbox such that no intervening equipment is between the pulper and headbox to adjust a consistency of the fiber stock, and wherein the conduit is configured to move the foam-suspended fiber stock from the pulper to the headbox in a time less than the half-life; and a foam return device that is directly connected to the pulper and that removes at least some of the foam from the forming wire and returns the at least some of the foam to the pulper, wherein a time it takes to move the at least some of the foam from the foam return device to the pulper is less than the half-life.

2. The system of claim 1, wherein the at least some of the foam returned to the pulper remains in a foam state from the forming wire to the pulper.

3. The system of claim 1, wherein the surfactant is one of Coco-Glucoside and Cetrimonium Chloride.

4. The system of claim 1, wherein the half-life is from thirty seconds to five minutes.

5. The system of claim 1, comprising an excess liquid removal device.

6. The system of claim 1, wherein the foam-suspended fiber stock in the headbox has a consistency of about 0.5 to 3%.

7. The system of claim 6, wherein the foam-suspended fiber stock in the headbox has a consistency of about 0.75 to 3%.

8. The system of claim 6, wherein the foam-suspended fiber stock in the headbox has a consistency of about 1 to 3%.

9. The system of claim 1, wherein the foam return device includes a conduit.

10. A system comprising:

a pulper configured to (i) accept surfactant, a liquid and fiber stock, and (ii) generate a foam that suspends the fiber stock and (iii) mix the surfactant, liquid and fiber stock, and wherein the foam-suspended fiber stock in the pulper has a first volume;

a headbox;

a conduit directly connecting the pulper to the headbox such that no intervening equipment is between the pulper and headbox, wherein the headbox is configured to receive the foam-suspended fiber stock from the pulper and displace the foam-suspended fiber stock onto a forming wire, the foam-suspended fiber stock in the headbox has a second volume and wherein the second volume is equal to or greater than half of the first volume; and a foam return device that is directly connected to the pulper and that removes at least some of the foam from the forming wire and returns the at least some of the foam to the pulper.

11. The system of claim 10, wherein the at least some of the foam returned to the pulper remains in a foam state from the forming wire to the pulper.

12. The system of claim 10, wherein the surfactant is one of Coco-Glucoside and Cetrimonium Chloride.

13. A system comprising:

a pulper configured to (i) accept surfactant, a liquid and fiber stock,_ and (ii) generate a foam that suspends the fiber stock and (iii) mix the surfactant, liquid and fiber stock;

a headbox;

a conduit directly connecting the pulper to the headbox such that no intervening equipment is between the pulper and headbox, wherein the headbox is configured to receive the foam-suspended fiber stock from the pulper and displace the foam-suspended fiber stock onto a forming wire, wherein the foam present in the headbox has a liquid volume; and a foam return device that is directly connected to the pulper and that removes at least some of the foam from the forming wire and returns at least fifty percent (50%) of the liquid volume of the foam to the pulper.

14. The system of claim 13, wherein the foam return device returns at least sixty percent (60%) of the liquid volume of the foam to the pulper.

15. The system of claim 14, wherein the foam return device returns at least seventy percent (70%) of the liquid volume of the foam to the pulper.

16. The system of claim 15, wherein the foam return device returns at least eighty percent (80%) of the liquid volume of the foam to the pulper.

17. The system of claim 16, wherein the foam return device returns at least ninety percent (90%) of the liquid volume of the foam to the pulper.

* * * * *